US012174003B2

(12) United States Patent
Muller et al.

(10) Patent No.: US 12,174,003 B2
(45) Date of Patent: Dec. 24, 2024

(54) SAFETY ARRANGEMENT FOR A WIRELESS BLASTING SYSTEM

(71) Applicant: DETNET SOUTH AFRICA (PTY) LTD, Johannesburg (ZA)

(72) Inventors: Elmar Lennox Muller, Centurion (ZA); Tielman Christiaan Meyer, Sandton (ZA); Abraham Johannes Liebenberg, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 229 days.

(21) Appl. No.: 17/923,451

(22) PCT Filed: Feb. 2, 2021

(86) PCT No.: PCT/ZA2021/050005

§ 371 (c)(1),
(2) Date: Nov. 4, 2022

(87) PCT Pub. No.: WO2021/222946

PCT Pub. Date: Nov. 4, 2021

(65) Prior Publication Data

US 2023/0194230 A1 Jun. 22, 2023

(30) Foreign Application Priority Data

Apr. 29, 2020 (NA) ..... NA/P/2020/0011

(51) Int. Cl.
*F42D 5/00* (2006.01)
*F42D 1/05* (2006.01)

(52) U.S. Cl.
CPC *F42D 5/00* (2013.01); *F42D 1/05* (2013.01)

(58) Field of Classification Search
CPC ..... F42D 5/00; F42D 1/05; F42D 1/045
See application file for complete search history.

(56) References Cited

U.S. PATENT DOCUMENTS 4,725,991 A * 2/1988 Crenwelge, Jr. ..... F42D 1/00 181/116
4,976,199 A * 12/1990 Beukes ..... F42D 1/055 102/311

(Continued)

FOREIGN PATENT DOCUMENTS

EP 1855077 A2 11/2007
WO 2006086843 A1 8/2006

(Continued)

OTHER PUBLICATIONS

International Preliminary Report on Patentability for PCT/ZA2021/050005, international filing date of Feb. 2, 2021, date of completion Feb. 16, 2022, 10 pages.

(Continued)

*Primary Examiner* — Joshua E Freeman
(74) *Attorney, Agent, or Firm* — CANTOR COLBURN LLP

(57) ABSTRACT

A safety arrangement for a wireless blasting system which includes a plurality of wireless detonator assemblies located at a blast zone wherein each route which provides access to the blast zone is monitored to detect removal of a wireless detonator assembly which is in an operative mode from the blast zone.

9 Claims, 3 Drawing Sheets

(56) References Cited

U.S. PATENT DOCUMENTS 5,214,236 A * 5/1993 Murphy ..... F42D 1/05 102/215
5,539,636 A * 7/1996 Marsh ..... F42D 1/055 700/286
6,079,333 A * 6/2000 Manning ..... F42D 1/05 102/420
6,422,147 B1 * 7/2002 Shann ..... F42D 1/055 102/320
7,958,824 B2 * 6/2011 Stewart ..... F42D 1/05 102/200
8,839,720 B2 * 9/2014 Stewart ..... F42D 1/05 102/200
9,091,518 B2 * 7/2015 Lownds ..... F42D 1/045
9,091,519 B2 * 7/2015 Lownds ..... F42D 1/045
9,127,921 B2 * 9/2015 Koekemoer ..... F42C 11/001
9,791,253 B2 * 10/2017 Rothenbuhler ..... F42C 13/04
2004/0225431 A1 * 11/2004 Aebi ..... F42D 1/055 701/115
2005/0000382 A1 * 1/2005 Hummel ..... F42D 5/00 102/221
2005/0103219 A1 * 5/2005 McClure ..... F42D 1/055 102/311
2006/0027121 A1 * 2/2006 Koekemoer ..... F42D 1/05 102/301
2006/0262480 A1 * 11/2006 Stewart ..... F42D 1/05 361/251
2006/0272536 A1 * 12/2006 Lownds ..... F41A 17/066 361/251
2009/0314176 A1 * 12/2009 Lownds ..... F42D 1/045 102/301
2011/0067591 A1 * 3/2011 Stewart ..... F41A 17/066 102/301
2014/0311370 A1 * 10/2014 Koekemoer ..... F42C 11/001 102/217
2015/0192396 A1 * 7/2015 Rothenbuhler ..... F42D 5/00 102/200
2017/0030695 A1 * 2/2017 Kruger ..... F42D 5/00
2017/0082412 A1 * 3/2017 Rothenbuhler ..... F42D 5/00
2020/0088503 A1 * 3/2020 Rothenbuhler ..... F42C 13/04
2023/0057631 A1 * 2/2023 Muller ..... F42D 1/045

FOREIGN PATENT DOCUMENTS

WO 2009025562 A1 2/2009
WO 2011160099 A1 12/2011
WO 2013044275 A1 3/2013
WO 2015103607 A1 7/2015

OTHER PUBLICATIONS

International Search Report for PCT/ZA2021/050005, international filing date of Feb. 2, 2021, date of mailing Sep. 10, 2021, 6 pages.
Written Opinion for PCT/ZA2021/050005, international filing date of Feb. 2, 2021, date of mailing Sep. 10, 2021, 8 pages.

* cited by examiner

SAFETY ARRANGEMENT FOR A WIRELESS BLASTING SYSTEM

CROSS-REFERENCE TO RELATED APPLICATIONS

This application is a U.S. national stage application of International Application No. PCT/ZA2021/050005 entitled "A SAFETY ARRANGEMENT FOR A WIRELESS BLASTING SYSTEM", which has an international filing date of 2 Feb. 2021, and which claims priority to Namibian Patent Application No. NA/P/2020/0011, filed 29 Apr. 2020.

BACKGROUND OF THE INVENTION

This invention relates generally to a wireless blasting system and, more particularly, to an arrangement for enhancing the safety of that type of system.

A wireless blasting system makes use of wireless detonators which can be unidirectional i.e. capable of receiving signals only, or bidirectional i.e. capable of receiving signals and of transmitting signals. The signals which are transmitted are either at radio frequencies or use is made of magnetic techniques for signal transmission.

In a wireless system each detonator assembly is normally formed from components which, by themselves, are inherently safe. These components are interconnected to make up a detonator assembly which is installed into a blasthole shortly before use. For safety reasons, the detonator assembly is in an inoperative mode in which firing is not possible but, when required, the assembly is placed into an operative mode in which it can be fired.

Although the placing of a detonator assembly into an operative mode is done only at a blast face there is a possibility that a detonator assembly will not be correctly installed in a blasthole or, even if correctly installed, that the assembly will be unable to carry out its dedicated purpose. This type of event can be due to various reasons. For example a detonator assembly might misfire and, when rock is removed from a blast zone, the detonator assembly, in an operative mode, could be in a muck pile produced by the blast. A detonator assembly could fall out of a blasthole after deployment or it could be shaken loose from its installed position due to blasting in an adjacent region. An assembly could be overlooked or misplaced by personnel, it could malfunction during preparatory work and then not be disassembled, an assembly could maliciously be removed from a blasthole, or the like.

Occurrences of the aforementioned kind harbour a risk to people and to equipment outside the blast area. As the detonator assemblies have no physical connections it can be difficult to detect the presence of a detonator assembly which is outside of a work zone. Inherent in a wireless blasting system is that wireless signals are sent from control equipment to arm and fire each detonator assembly. These signals could reach a detonator assembly which is not in a blast zone and cause that detonator assembly to fire with serious consequences.

An object of the present invention is to address, at least to some extent, the aforementioned possibility.

SUMMARY OF THE INVENTION

The invention provides a safety arrangement for a wireless blasting system wherein the wireless blasting system includes a plurality of wireless detonator assemblies each of which is configured to be placed into an operative mode or into an inoperative mode, a blast zone which includes a plurality of boreholes into each of which at least one said detonator assembly is installed, wherein access to the blast zone is via one or more defined access routes, and control apparatus operative to transmit command signals to the plurality of wireless detonator assemblies, and wherein the safety arrangement includes a plurality of monitoring devices with at least one monitoring device being positioned adjacent a respective access route, each monitoring device being configured to initiate corrective action in respect of a said wireless detonator assembly which is in an operative mode and which is in the said access route.

Typically, in an underground situation an access route would comprise a tunnel. On surface an access route could be a roadway, a rail track, a conveyor system, a gateway or the like.

In one embodiment of the invention the monitoring device includes at least one scanner which detects a wireless detonator assembly which is in an operative mode and which then via a control unit sounds an alarm (visual or audible). The alarm enables action to be taken by personnel who are alerted by the alarm.

The nature of the scanner depends at least on technical characteristics of the detonator. The scanner includes at least one appropriate detector which by way of example may be an optical, NFC, RFID, or a short-range RF device.

Additionally or alternatively the monitoring device may include a transmitter which, as required, transmits a neutralising signal to change the status of the wireless detonator assembly from the operative mode. The wireless detonator assembly could then be placed into an inoperative mode by means of a controller which is responsive to such neutralising signal. This could be done in variety of ways. Data in a memory in the wireless detonator assembly can be erased or altered, a fuse which is critical to the operation of the wireless detonator assembly could be fired, a power supply in the wireless detonator could be isolated, or any other appropriate action could be taken to render the wireless detonator assembly inutile at that point. Depending on the nature of the corrective action the wireless detonator assembly could then be recovered and it could be returned to the manufacturer of the assembly so that it is available for re-use, if appropriate.

In another form of the invention the monitoring device continuously transmits universal wake-up, and terminate, commands. These transmissions are of a limited range so that they are only effective in the immediate vicinity of the monitoring device i.e. in an adjacent region of the access route which must be traversed to exit the blast zone and at which the monitoring device is located.

The safety arrangement is one in which a wireless detonator assembly which is in an operative mode is detected and then rendered non-functional. This aspect enables any unassembled components of a wireless detonator assembly to be moved past a monitoring device without hindrance, and without risk that its function can be interfered with.

BRIEF DESCRIPTION OF THE DRAWINGS

The invention is further described by way of example with reference to the accompanying drawings in which.

DESCRIPTION OF PREFERRED EMBODIMENT

Figure 1:
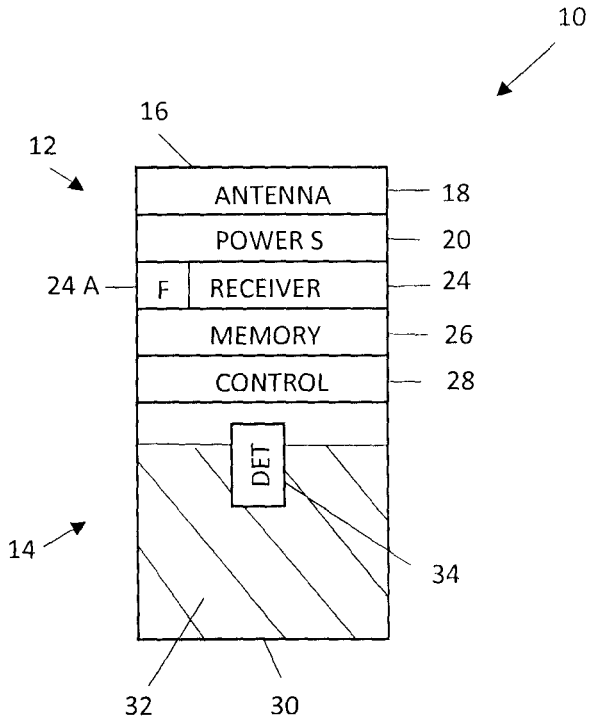
FIG. 1 is a schematic representation of a wireless detonator assembly.

FIG. 1 of the accompanying drawings is a schematic depiction of a wireless detonator assembly 10. Typically the assembly 10 is made from a first part 12 and a second part 14 which are kept apart from each other and which are only interconnected on site as may be required. This is primarily for safety reasons.

The first part 12 includes a housing 16 and, mounted in or to the housing, an antenna 18, a source 20 of power, a radio receiver 24 which is connected to the antenna 18, a memory unit 26 and a control circuit 28.

The second part 14 includes a housing 30 with explosive material 32.

A detonator 34 is connected, when required, to terminals on the control circuit 28 and is exposed to the explosive 32.

As the first part 12 is kept away from the second part 14 the power source 20 cannot interact with the explosive material 32. Also the detonator 34 is kept separate from the first part 12 and the second part 14. Thus the detonator cannot inadvertently be fired by the power source nor can the detonator, if fired, initiate the explosive 32.

The receiver 24 can be associated with a transmitter (not shown) in a bidirectional system. The receiver 24 and antenna 18 are configured, according to requirement, to operate at radio frequencies or to be responsive to an electromagnetic signal sent from a magnetic source.

Figure 2:
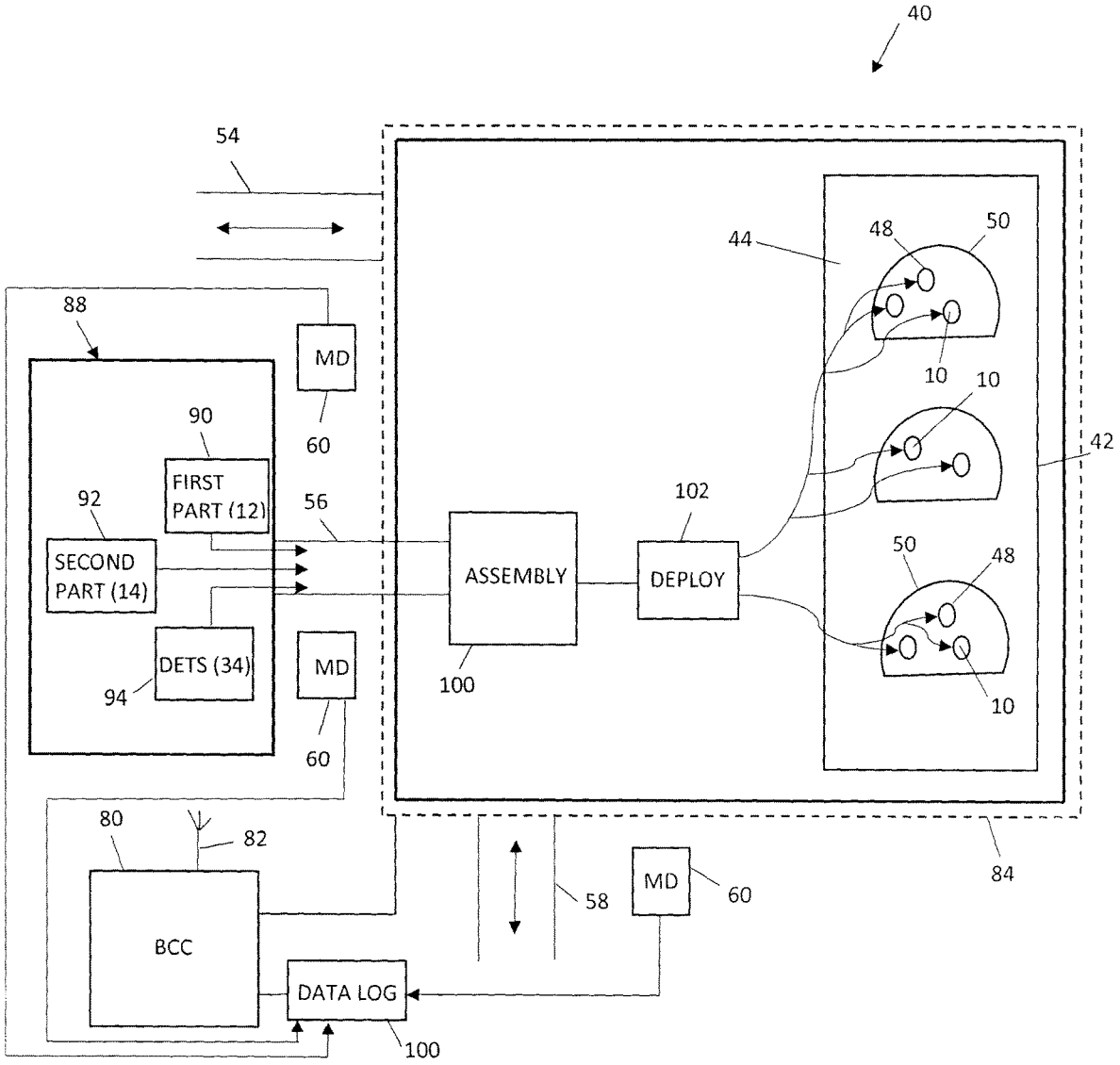
FIG. 2 illustrates in block diagram form a blast site at an underground location.

FIG. 2 illustrates a wireless blasting system 40 according to the invention which is located in an underground location defined by an excavation 42. A blast zone 44 is inside the excavation 42. A plurality of boreholes 48 are formed in one or more rock faces 50 using techniques known in the art. Typically access to the excavation 42 is via a number of well-defined access routes such as tunnels which may form roadways or pathways for ore-carrying vehicles, not shown. In this example three access routes 54, 56 and 58 are shown.

Figure 3:
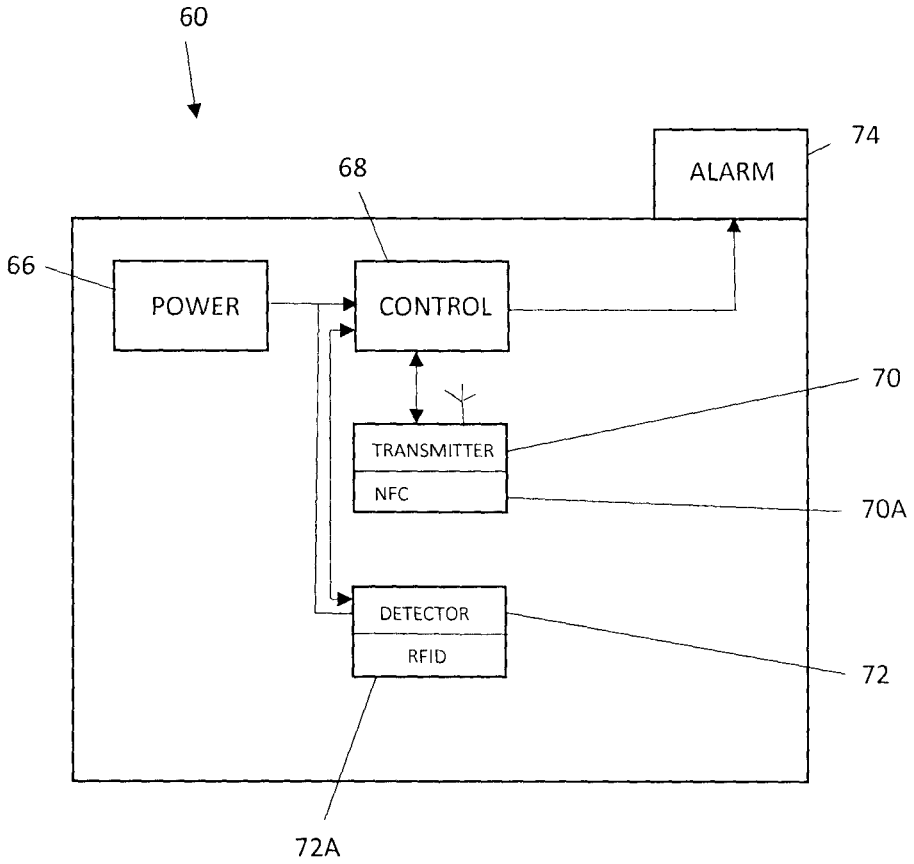
FIG. 3 illustrates in block diagram form a monitoring device for use in the safety arrangement of the invention.

A respective monitoring device 60 is positioned adjacent each access route 54, 56 and 58. The monitoring device 60 is shown in FIG. 3 and includes a power source 66, a control circuit 68, a transmitter 70, a scanner or detector 72 and an alarm enunciator or signalling device 74. As is apparent from the following description some of the components in the monitoring device 60 are optional.

FIG. 2 also illustrates a blast control centre 80, which is of known construction. Depending on the nature of each wireless blasting assembly 10 the blast control centre 80 can transmit command and execute signals at radio frequencies via an antenna 82, or command and control signals in magnetic form via a substantial loop antenna 84. These aspects, which are known in the art, are exemplary only and are non-limiting.

A storage facility 88 is positioned at a safe location displaced from the blast zone 44. At this facility separate storage units 90, 92 and 94 contain, respectively, quantities of the first part 12 of the detonator assemblies 10, quantities of the second part 14 of the detonator assemblies, and a plurality of the detonators 34.

In order to establish the blasting system 40 one or more operators draw components from the stores 90, 92 and 94 and these components are conveyed through the access route 56 to an assembly location 100. A first part 12 is connected in a known manner to a second part 14 and a detonator 34 is connected in circuit between the first and second parts. In a subsequent step 102 assembled wireless blasting assemblies 10 are deployed by being placed into respective boreholes 48.

Once the deployment process has been finished and subject to various safety protocols being carried out, the blast control centre 80 transmits to the wireless detonator assemblies 10 in the blast zone 44 a control signal. The respective antenna 16 of each assembly 10 detects the signal which is transferred to the corresponding receiver 24 and then to the control circuit 28. Thereafter the control circuit 28 places the associated assembly 10 into an operative mode. In this mode each assembly can be fired by means of a fire signal sent from the blast control centre 80. Blasting then takes place.

As indicated in the preamble hereof it is feasible that a wireless detonator assembly 10, despite various safety procedures, can be placed into an operative mode and thereafter is not utilised in the desired manner. For example an assembly 10, correctly positioned in a borehole, could be shaken loose by firing of detonators in an adjacent region. A detonator assembly could, maliciously, be removed from an installed location. A detonator assembly, even if in an operative mode, might not respond to a fire signal. At the assembly location 100 a detonator assembly, although correctly interconnected or put together, might, due to an oversight by personnel, then not be deployed into a blasthole. Whatever the cause it is conceivable that a wireless detonator assembly 10 which is in an operative mode might not be fired and, thereafter, might be removed from the blasting zone 44 without responsible personnel being made aware thereof. As the detonator assembly in question would then be operative it could respond to a subsequent firing signal or it could be initiated due to an extraneous cause. The invention is intended to address this possibility.

As stated a respective monitoring device 60 is positioned at each of the access routes 54, 56 and 58. Particularly at an underground excavation the number of access routes which allow ingress to the excavation or egress from the excavation is limited and known. Each monitoring device 60 is positioned to detect, by means of the detector 72 which continuously scans a portion of the access route through which passage must take place, movement of a wireless detonator assembly 10 which is in an operative mode, through the access route. The manner in which this is done and the corrective action which is taken thereafter depend to some extent at least on the nature of the detonator assembly 10.

Firstly if the detector 72 detects the passage of an operative detonator assembly then an alarm 74 (visual or audible) could be sounded so that responsible personnel can take remedial action.

Secondly the receiver 24 or any other critical component in a detonator assembly can be deactivated or rendered inutile by means of a neutralising signal which could take different forms. For example the neutralising signal may comprise a radio signal sent using NFC (near field communication) or RF techniques. A magnetic signal can also be transmitted to deactivate the receiver.

Deactivation of a detonator assembly 10, which is in an operative mode, can be done in several ways. For example responsive to receipt of the neutralising signal by the receiver 24 the memory 26 can be cleared so that the receiver 24 and the control circuit 28 then have no mechanism for responding to commands or control signals which might come from the blast control centre 80 or a similar blast control centre.

Typically, after a detonator assembly has been programmed, programming data resides in the memory unit 26, usually in an EEPROM. If this data is cleared the receiver cannot respond to a command or control signal.

In another form of construction the detonator assembly 10 includes a fuse 24A which is an essential component. For example a critical element such as the receiver 24 might only be functional if the fuse 24A is sound. If the fuse 24A is blown responsive to receipt of the neutralizing signal by the receiver 24 then the receiver 24 is rendered non-functional. It is therefore possible to transmit a neutralizing signal from the monitoring device 60 to blow the fuse 24A so that the detonator assembly 10 is then non-utile. With this arrangement the detonator assembly can be returned to a manufacturer for reconditioning or it can be destroyed safely.

In another approach, again responsive to a neutralizing signal, the power supply 20 is caused to discharge, completely, so that no energy is available to activate the detonator assembly.

The monitoring device 60, in the detector 72, can include an RFID scanner 72A and, in the transmitter 70, an NFC transmitter 70A. If a receiver 24 in a detonator assembly 10 is detected by the RFID scanner 72A then deactivation of the detonator assembly can be effected by means of a short range RF neutralizing signal sent from the transmitter 70. Another option is to design the transmitter 70 so that it continuously transmits universal wake-up and terminate commands. A receiver 24 which is in range of the transmitter 70, upon receipt of a wake-up command, is then activated (if not already activated), and a following terminate command which is then sent, depending on the nature of the arrangement adopted, causes data to be cleared from the memory 26, or the fuse 24A to be blown, or both events to occur, or some other deactivating action to be taken. This approach is also applicable if the detonator assembly 10 is based on the use of magnetic signals.

The monitoring devices 60 only detect detonator assemblies 10 which are operative. This means that components or parts of detonator assemblies which are being moved towards or away from the assembly location 100 pass the monitoring devices unimpeded and the normal assembly and deployment processes can continue without interference.

The monitoring devices 60 are preferably connected to a supervisory/data logging network 100 to detect, track and record the movement of detonator assemblies from the blast zone i.e. from the blast site 44 or excavation 42—this is for control, record-keeping, and safety purposes.

The invention claimed is:

1. A wireless blasting system which includes a plurality of wireless detonator assemblies each of which is configured to be placed into an operative mode or into an inoperative mode, a blast zone which includes a plurality of boreholes into each of which at least one said wireless detonator assembly is installed, one or more defined access routes to the blast zone, control apparatus operative to transmit command signals to the plurality of wireless detonator assemblies, and a plurality of monitoring devices, at least one monitoring device being positioned adjacent a respective access route, each monitoring device being configured to initiate corrective action in respect of a said wireless detonator assembly which is in an operative mode, which has been removed from the blast zone and which is in the said access route.

2. A wiring blasting system according to claim 1 wherein each monitoring device includes a respective scanner which, upon detecting a wireless detonator assembly which is in an operative mode and which is in the respective access route, then sounds an alarm.

3. A wireless blasting system according to claim 1 wherein each monitoring device is operable to change the status of the wireless detonator assembly which is in the respective access route from the operative mode.

4. A wireless blasting system according to claim 3 wherein the monitoring device includes a transmitter which is operable to transmit a neutralizing signal to the wireless detonator assembly to change said status.

5. A wireless blasting system according to claim 1 wherein said corrective action comprises placing said wireless detonator assembly into an inoperative mode.

6. A wireless blasting system according to claim 3 wherein the wireless detonator assembly is configured to be placed into an inoperative mode by means of a neutralizing signal from the monitoring device using at least one technique selected from the following: erasing or altering data in a memory in the wireless detonator assembly; firing a fuse which is critical to the operation of the wireless detonator assembly; isolating or discharging a power supply in the wireless detonator assembly; deactivating a receiver in the wireless detonator assembly.

7. A wireless blasting system according to claim 1 wherein said at least one monitoring device continuously transmits universal wake-up, and terminate, commands which are of a limited range so that the commands are only effective in an adjacent region of the access route at which the monitoring device is located and in that a wireless detonator assembly, upon receipt of said terminate command, is placed into an inoperative mode.

8. A wireless blasting system according to claim 1 which includes a supervisory/data logging network, to which the monitoring devices are connected, which detects, tracks and records, the movement of the wireless detonator assemblies from the blast zone.

9. A wireless blasting system according to claim 1 wherein each wireless detonator assembly includes a first part, a second part and a detonator, the first part comprising a housing and, mounted in or to the housing, an antenna, a power source, a radio receiver, a memory unit and a control circuit, the second part including a housing with explosives material, wherein, prior to deployment, the first part is connected to the second part and the detonator is connected in circuit to the first part and to the second part, the control circuit being configured to place the wireless detonator assembly into an operative mode upon receipt by the receiver of a control signal and, upon receipt of a neutralizing signal by the receiver the control circuit is configured to place the wireless detonator assembly into an inoperative mode using a technique selected from the following: erasing or altering data in the memory unit, firing a fuse which is critical to the operation of the wireless detonator assembly, isolating or discharging the power source, and deactivating the receiver.

* * * * *